US006761780B2

(12) United States Patent
Morito et al.

(10) Patent No.: US 6,761,780 B2
(45) Date of Patent: Jul. 13, 2004

(54) METHOD OF MANUFACTURING A HIGH MN NON-MAGNETIC STEEL SHEET FOR CRYOGENIC TEMPERATURE USE

(75) Inventors: Nobuyuki Morito, Okayama (JP); Kiyohiko Nohara, Tokyo (JP); Katsuhiro Kobori, Chiba (JP); Ujihiro Nishiike, Tokyo (JP); Takako Yamashita, Chiba (JP)

(73) Assignee: JFE Steel Corporation, Tokyo (JP)

( * ) Notice: Subject to any disclaimer, the term of this patent is extended or adjusted under 35 U.S.C. 154(b) by 15 days.

(21) Appl. No.: 10/013,532

(22) Filed: Dec. 13, 2001

(65) Prior Publication Data

US 2002/0121318 A1 Sep. 5, 2002

Related U.S. Application Data

(63) Continuation-in-part of application No. 09/492,347, filed on Jan. 27, 2000, now abandoned.

(30) Foreign Application Priority Data

Jan. 27, 1999 (JP) ..... 11-017912

(51) Int. Cl.[7] ..... C21D 8/12
(52) U.S. Cl. ..... 148/620
(58) Field of Search ..... 148/619, 620

(56) References Cited

U.S. PATENT DOCUMENTS 4,290,828 A 9/1981 Aisaka et al.
5,431,753 A 7/1995 Kim et al.

FOREIGN PATENT DOCUMENTS

| | | |
|---|---|---|
| JP | 57126923 | 8/1982 |
| JP | 63235428 | 9/1988 |
| JP | 02205631 | 8/1990 |
| JP | 04272130 | 9/1992 |
| JP | 06100941 | 4/1994 |
| JP | 63259022 | 10/1998 |

OTHER PUBLICATIONS

Temper Rolling, The Making, Shaping and Treating of Steel, ed. By H. E. McGannon, 1964, 8$^{th}$ Edition, p. 928.

"Annealing", Academic Press Dictionary of Science and Technology, http://harcourt.com/dictionary/def/5/9/2/4/592400. html, accessed in Feb. 7, 2001.

*Primary Examiner*—Roy King
*Assistant Examiner*—Harry D. Wilkins, III
(74) *Attorney, Agent, or Firm*—Young & Thompson

(57) ABSTRACT

A method of manufacturing a high Mn non-magnetic steel sheet having low permeability at a cryogenic temperature suitable for use in large scale particle accelerators, the method comprises rolling a steel material containing, on the wt % basis, from 0.05 to 0.18% of C, from 26.0 to 30.0% of Mn, from 5.0 to 10.0% of Cr, 0.05 to 0.15% of N and, optionally, from 0.50 to 5.0% of Ni, in which a rolling start temperature is from 1050 to 1200° C. and a rolling end temperature is from 700 to 1000° C. Further, a cold rolled sheet is annealed at an annealing temperature for cold rolled sheet of from 1050 to 1200° C. and cooled after annealing, the annealed sheet being preferably applied with temper rolling under control for the strength by varying a draft ratio.

4 Claims, 1 Drawing Sheet

Figure 1:
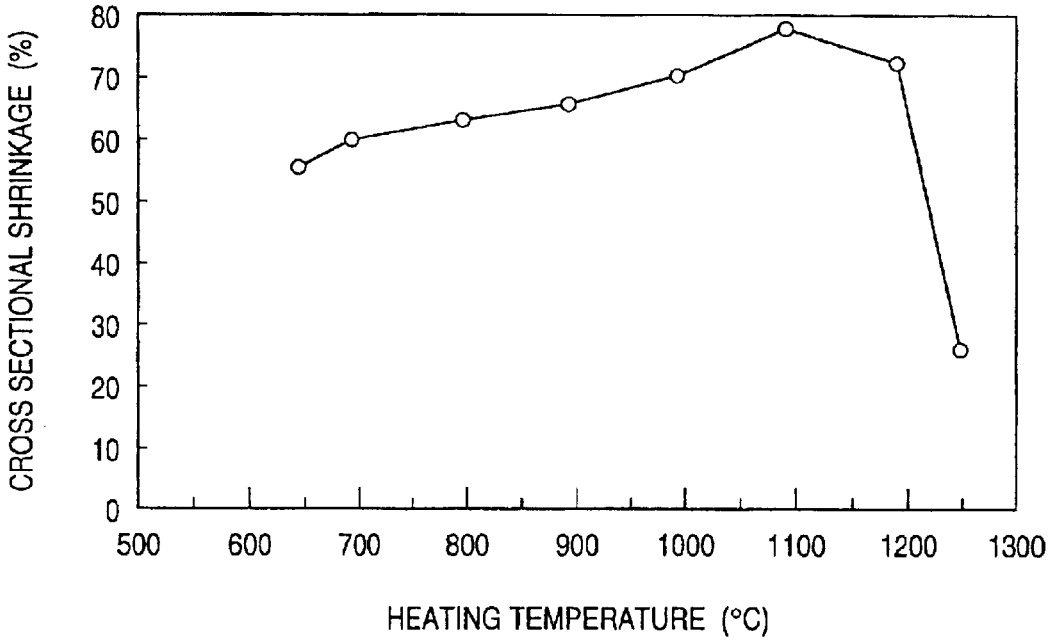

METHOD OF MANUFACTURING A HIGH MN NON-MAGNETIC STEEL SHEET FOR CRYOGENIC TEMPERATURE USE

CROSS-REFERENCE TO RELATED APPLICATION

This application is a continuation-in-part application of application Ser. No. 09/492,347 filed on Jan. 27, 2000 now abandoned.

BACKGROUND OF THE INVENTION

1. Field of the Invention

The present invention concerns a structural material for cryogenic temperature use and, more in particular, it relates to a non-magnetic structural material for cryogenic temperature use, required for constituting superconductive magnets. The steel sheet referred to this invention includes steel sheets and steel strips.

2. Description of the Related Art

In various techniques utilizing super conductivity such as nuclear fusion power generation, particle accelerators, and superconductive power storage, superconductive magnets are used in view of the requirement of supplying a large amount of current for generating strong magnetic fields. Since large electromagnetic forces are induced in the superconductive magnet and it is usually cooled to a cryogenic temperature at 2–4 K by liquid helium, structural materials supporting the superconductive magnet require high strength capable of withstanding the large electromagnetic forces under the cryogenic temperature. In addition, since it is a basic object to generate a strong magnetic field at a uniform and stable distribution and in a range as wide as possible, it is essential to minimize the effects of the structural materials on the magnetic fields. Accordingly, it is an essential condition for the materials that they are non-magnetic materials not causing interaction with the magnetic fields.

In view of the above, the structural materials used at the inside or the periphery of the superconductive magnet are required to have high mechanical characteristics and extremely low magnetic permeability at a cryogenic temperature and, further, it is also necessary to take a consideration on thermal deformation in order to firmly hold the superconductive magnet in a composite structure. Further, in the manufacture of the superconductive magnet, it is required for the structural materials that they are excellent in machinability such as punching or boring property or weldability and, further, also excellent in surface flatness or fitness required for laminating a plurality of sheets.

Existent materials considered as structural materials for supporting the superconductive magnet can include austenitic stainless steels, high Mn steels, aluminum alloys, titanium alloys and fiber-reinforced plastics. The mechanical strength, the magnetic permeability and the thermal expansion coefficient required for the structural materials for supporting the superconductive magnet vary depending on the designed intensity of the magnetic fields in the superconductive magnet to be manufactured or the aimed uniformity for the distribution of the magnetic fields and it is important for the selection of the materials that the strength is high, and the permeability and the thermal expansion coefficient are low at a cryogenic temperature.

The fiber-reinforced plastics are non-magnetic and easy to handle with being of low specific gravity and have lower thermal expansion coefficient compared with austenitic stainless steels but the strength per unit cross sectional area is lower. Further, while titanium alloys are low in the specific gravity and high in the strength and have high specific strength, they involve a problem that the toughness is low at a low temperature and is expensive.

Aluminum alloys are used in various applications at cryogenic temperatures since they are light in weight, and have high specific strength and extremely low permeability but they lack in the strength when the designed magnetic fields are applied as in large scale particle accelerators and also involve a problem in the weldability.

Since usual austenitic stainless steels are insufficient in the strength and the toughness at low temperatures, stainless steels of low carbon content with addition of nitrogen have been developed. However, since the stability in the austenitic phase is insufficient in such stainless steels, a portion of the austenitic phase is transformed into a ferromagnetic martensitic phase by deformation at a low temperature. Accordingly, this results in lowering of the toughness and involves a problem that the permeability can not be lowered sufficiently at a cryogenic temperature.

Subsequently, austenitic stainless steels with further increased Ni. content have been developed but they involve a problem of increased cost and high thermal expansion coefficient as the structural material for cryogenic temperature use.

In view of the problems described above, Japanese Patent Publications No. 11661/1984 and No. 18887/1993 propose relatively inexpensive high Mn non-magnetic steels and manufacturing methods thereof. However, the high Mn non-magnetic steels described in Japanese Patent Publication No. 11661/1984 have high permeability at a cryogenic temperature and involve problems as a large scale particle accelerator use. The technique disclosed in Japanese Patent Publication No. 18887/1993 involves problems of requiring long time aging treatment and lowering the productivity.

Further, in the superconductive magnet, a non-magnetic member referred to as a collar is required as fixing members for superconducting wires as conductor coils and the collar is formed by laminating a plurality of non-magnetic steel sheets. Then, the collar also requires an appropriate mechanical strength in order to withstand strong electromagnetic forces caused when it is cooled to a cryogenic temperature and a large amount of current is supplied as the superconductive magnet. However, when the mechanical strength of the non-magnetic steel sheet is excessively high or the residual stress therein is excessive, the working life of a punching die is shortened or warps are caused after punching the non-magnetic steel sheet into a predetermined shape of the collar.

In the superconductive magnet, the collar is often manufactured by precision punching such as fine blanking. With the view point as described above, the mechanical strength of the material used for the collar is determined while taking the strength and the distribution of the designed magnetic field into a consideration. Accordingly, it has been demanded for a method of manufacturing a non-magnetic steel sheet that can easily control the strength of the non-magnetic steel sheet as the material to a desired strength demanded in the design.

OBJECT OF THE INVENTION

An object of this invention is to effectively overcome the foregoing problems in the prior art and provide a method of manufacturing a high Mn non-magnetic steel sheet for cryogenic temperature use, capable of manufacturing, with industrial stability and high productivity, and a high Mn non-magnetic steel sheet which is suitable for use in large scale particle accelerators, and has a high yield point at a cryogenic temperature and low permeability at the cryogenic temperature.

SUMMARY OF THE INVENTION

In order to attain the foregoing subject, the present inventors have investigated characteristics required for supporting structural members used in superconductive magnets for use in large scale particle accelerators and have made an earnest study for the factors giving effects on the permeability and the yield stress at a cryogenic temperature of high Mn non-magnetic steel sheets. As a result, it has been found that the permeability of the high Mn non-magnetic steel at the cryogenic temperature can be lowered by further stabilizing the austenitic phase by increasing the content of Mn. Further, it has been found that the yield stress of the high Mn non-magnetic steel at the cryogenic temperature can be controlled easily to 900 MPa or more by applying temper rolling to a steel sheet after intermediate annealing.

This invention has been constituted based on the findings described above. That is, this invention provides a method of manufacturing a hot rolled high Mn non-magnetic steel sheet for cryogenic temperature use, which comprises:

heating a steel material containing, on the weight percent basis:
from 0.05 to 0.18% of C,
from 26.0 to 30.0% of Mn,
from 5.0 to 10.0% of Cr,
from 0.05 to 0.15% of N,
from 0.01 to 0.07% of Al,
from 0.01 to 0.1% of V,
from 0.1 to 1.0% of Si and
from 0.003 to 0.02% of Ca and hot rolling the material into a hot rolled steel sheet, in which a hot rolling start temperature is from 1050 to 1200° C. and the rolling end temperature is 700 to 1000° C. for the hot rolling. Further, in a preferred embodiment of this invention, the steel material preferably contains, on the weight percent basis: from 0.05 to 0.18% of C, from 26.0 to 30.0% of Mn, from 5.0 to 10.0% of Cr, from 0.50 to 5.0 of Ni and from 0.05 to 0.15% of N, from 0.01 to 0.07% of Al, from 0.01 to 0.1% of V, from 0.1 to 1.0% of Si and from 0.003 to 0.02% of Ca.

Further, this invention provides a method of manufacturing a cold rolled high Mn non-magnetic steel sheet for cryogenic temperature use, which comprises:

heating a steel material containing, on the weight percent basis:
from 0.05 to 0.18% of C,
from 26.0 to 30.0% of Mn,
from 5.0 to 10.0% of Cr,
from 0.05 to 0.15% of N,
from 0.01 to 0.07% of Al,
from 0.01 to 0.1% of V,
from 0.1 to 1.0 of Si and
from 0.003 to 0.02% of Ca and hot rolling the material into a hot rolled steel sheet, applying hot rolled plate annealing for the hot rolled sheet then applying cold rolling to form a cold rolled sheet and then applying annealing to the cold rolled sheet, in which a hot rolling start temperature is from 1050 to 1200° C. and a rolling end temperature is 700 to 1000° C. for the hot rolling and, further, the annealing temperature for the cold rolled sheet annealing is from 1050 to 1200° C.

Further, in this invention, the steel material is, preferably, a steel material containing, on the weight percent basis, from 0.05 to 0.18% of C, from 26.0 to 30.0% of Mn, from 5.0 to 10.0% of Cr, from 0.50 to 5.0 of Ni and from 0.05 to 0.15% of N, from 0.01 to 0.07% of Al, from 0.01 to 1.0% of V, from 0.1 to 1.0% of Si and from 0.003 to 0.02% of Ca. Further, in this invention, temper rolling at a draft ratio of 30% or lower is preferably applied after the cold rolled sheet annealing.

DESCRIPTION OF PREFERRED EMBODIMENTS

At first, the reason for defining the chemical compositions of the steel material is to be explained.

C: 0.05–0.18%, N: 0.05–0.15%

Both of C and N are interstitial solute elements, which are effective for increasing the strength of steels by solid-solution hardening. For obtaining a desired yield stress at a cryogenic temperature, it is necessary to contain C and N by 0.05% or more. On the other hand, when C exceeds 0.18%, the austenitic phase becomes instable to precipitate carbides, and the permeability can no more be kept lower at a cryogenic temperature, and the weldability and the workability are deteriorated. Accordingly, C is defined within a range from 0.05 to 0.18%. A preferred range for C is from 0.07 to 0.15%.

Further, N is an addition element useful for stabilizing the austenitic phase and increasing of the strength at a cryogenic temperature but, if the content exceeds 0.15%, the weldability is deteriorated and abrasion of a tool upon punching fabrication is accelerated, as well as the permeability is increased by precipitation of nitrides or carbonitrides. Accordingly, N is defined within a range from 0.05 to 0.15%. A preferred range for N is from 0.07 to 0.13%.

Mn: 26.0–30.0%

Mn is an important element in this invention, which is useful for stabilizing the austenitic phase and attaining an extremely low permeability even at a cryogenic temperature. In order to obtain such an effect, it is necessary to contain Mn by 26.0% or more. On the other hand, if it exceeds 30.0%, the toughness and the weldability, as well as the productivity are deteriorated, so that Mn is defined within a range from 26.0 to 30.0%.

Cr: 5.0–10.0%

Cr contributes to the increase of the strength by solid-solution hardening and also functions effectively to the improvement of corrosion resistance. Such an effect is recognized at the content of 5.0% or more but the content in excess of 10.0% hinders stabilization of the austenitic phase and results in increase of the permeability at a low temperature. Therefore, Cr is defined within a range from 5.0 to 10.0%. The circumstance in which the material as a target of this invention is used is basically at cryogenic temperature and in high vacuum where chemical reactions proceed extremely slowly, which is not so severe in view of corrosion and a sufficient corrosion resistance can be ensured by the Cr content at such a level. A preferred range for Cr is from 6 to 8%.

Ni: 0.50–5.0%

Ni contributes to the stabilization of the austenitic phase and improvement of the toughness at a cryogenic temperature, as well as improves the corrosion resistance. It can be contained optionally in this invention. Such effect is recognizable at the content of at least 0.50% or more, a great amount of content is not industrially desirable since Ni is expensive. Therefore, Ni is preferably within a range from 0.50 to 5.0%. According to this, the steel material of this invention have remarkable advantages not only in the thermal expansion coefficient but also in view of the cost, as compared with high Ni austenite stainless steels such as SUS 316LN.

Al: 0.01–0.07%

Al is an element effective as a deoxidizer and is a ferrite stabilizing element. If included excessively, it makes austenite phase unstable and consequently an extremely low magnetic permeability, which is an object of the present invention, can not be achieved. But in contrast, when Al content is small, impurities, such as $Al_2O_3$ are generated, hot workability is deteriorated, and thus, causes the generation of surface defects originated in cracks. This disadvantageously necessitates treatments such as surface grinding, resulting in decrease in product yield and increase in burdening of load in production processes. Therefore, the lowest Al content is limited to 0.01%.

V: 0.01–0.1% V

An excess amount of V over 0.1% segregates V carbide and V nitride to lessen toughness or lower workability. Also, the area surrounding carbides- or nitride-segregated portion runs short of austenite formers, C and N, and the austenite layer becomes unstable and extremely low magnetic permeability at a cryogenic temperature is difficult to achieve. Although V content should be as small as possible, too small an amount results in conspicuous embrittlement at low temperature and therefore, the lowest limit of V is defined as 0.01%.

Si: 0.1–1.0%

Si is effective as a deoxidizer and can be added as necessary because Si does not deteriorate hot workability as Al does. However, Si, like Al, is a ferrite stabilizing element and if included excessively, austenite phase becomes unstable and consequently, an object of the present invention of extremely low permeability is difficult to achieve. Too small an amount of Si results in insufficient deoxidation, therefore, the lower limit of Si is 0.05, preferably 0.1%.

Ca: 0.003–0.02%

Ca is effective in making S, mingled as an inevitable impurity, harmless and improving hot workability. Such an effect is not secured with a small Ca amount and as such, the lowest Ca content is limited to 0.003%. A preferred addition amount for S is within a range from 0.004 to 0.01%, and it is effective for ensuring the hot workability to satisfy the following equation (1)

$$0.8\times Ca+30>S+O \quad (1)$$

in which the content for each of elements Ca, S and O is indicated on the weight ppm basis. As a more simple criterion for judgement, $Ca/S\geqq 2$, preferably, $Ca/S\geqq 3$ may also be used.

The balance other than the chemical compositions described above substantially comprises Fe and inevitable impurities. As the inevitable impurities, S: 0.005% or less, P: 0.05% or less and O: 0.005% or less are permissible with a view point of the industrial economy. Further, it is desirable that the contents for precipitates such as carbides, nitrides and carbonitrides, particularly, $Fe_3C$ and $Fe_4N$ that form ferromagnetic precipitates or deteriorate the stability of the austenitic phase are as low as possible.

In the method of manufacturing the high Mn non-magnetic steel sheet of this invention, the steel material of the chemical composition as described above is at first heated and hot rolled into a hot rolled sheet.

Since the steel material suitable to this invention contains a great amount of Mn and Mn is easily oxidized at a high temperature, it is not desired to excessively increase the temperature for heating slabs since this not only increases scale losses but also results in excessive formation of Mn fumes. Further, the hot workability of the steel material of the chemical composition described above is not always excellent.

DESCRIPTION OF THE ACCOMPANYING DRAWINGS

Figure 2:
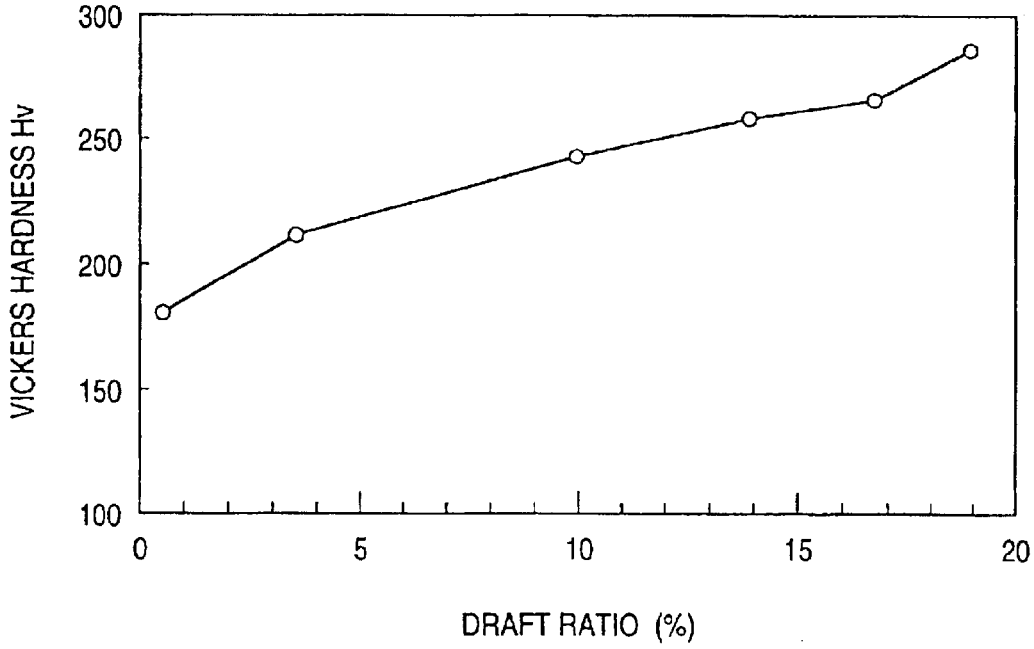

FIG. 1 is a graph showing a relation between a cross sectional shrinkage at rupture and a heating temperature in tensile test; and FIG. 2 is a graph showing a relation between a hardness (Hv) and a draft ratio in temper rolling.

Then, the hot workability of the steel material suitable to this invention (C: 0.12%, Si: 0.05%, Mn: 27.9%, P: 0.029%, S: 0.002%, Cr: 7.0%, N: 0.10%, Ni: 0.15% and Ca: 0.006%) was evaluated at first by a high temperature tensile test. The results are shown in FIG. 1. It can be seen from FIG. 1, that the cross sectional shrinkage decreases as the temperature exceeds 1200° C. and the trend of the hot shortness develops.

Then, for suppressing occurrence of edge cracks, the upper limit for the rolling start temperature in hot rolling is preferably 1200° C. On the contrary, when the rolling start temperature for hot rolling is lower than 1050° C., melting of carbides is insufficient and it results in disadvantages of increasing the deformation resistance. Therefore, the rolling start temperature for the hot rolling is within a range from 1050 to 1200° C. It is preferably from 1100 to 1180° C.

Further, it can be seen from FIG. 1 that the cross sectional shrinkage decreases to 60% or less when the tensile (heating) temperature is 700° C. or lower to deteriorate the hot workability.

Therefore, the rolling end temperature for the hot rolling is defined to 700° C. or higher in this invention. Further, when the rolling end temperature for the hot rolling exceeds 1000° C., crystal grains undesirably grow coarser by recrystallization. Therefore, the rolling end temperature for the hot rolling is defined within a range from 700 to 1000° C. It is preferably from 800 to 950° C. in view of prevention for edge cracks.

As is apparent, the hot rolled sheet can be used as a product sheet as it is or after application of hot rolled sheet annealing.

The hot rolled sheet is then applied with hot rolled sheet annealing. The hot rolled sheet annealing is conducted for homogenizing the structure. The hot rolled sheet annealing is desirably conducted within a temperature range from 950 to 1200° C. When the annealing temperature is lower than 950° C., the cross sectional shrinkage is decreased, whereas scales are formed excessively together with embrittlernent if the temperature exceeds 1200° C.

Then, the hot rolled sheet is applied with cold rolling into a cold rolled sheet. In this invention, the rolling condition is not necessarily restricted so long as a predetermined sheet thickness can be obtained by the cold rolling.

The cold rolled sheet fabricated to a predetermined sheet thickness is then applied with cold rolled sheet annealing.

The cold rolled sheet annealing is conducted mainly for the purpose of relieving internal strains caused by cold rolling, recrystallization and solid solution of precipitates. Particularly, this is an indispensable process for complete solid solution of carbides, nitrides and carbonitrides into an austenitic matrix phase to eliminate a precipitation phase disadvantageous to the keeping of the low permeability. The annealing temperature is from 1050 to 1200° C. When the annealing temperature is lower than 1050° C., solid solution of precipitates is insufficient. On the other hand, if it exceeds 1200° C., continuous annealing can not be conducted industrially stably. A preferred annealing temperature is from 1050 to 1180° C. Further, the holding time for annealing is desirably such that the temperature of the sheet is kept at the temperature described above for 10 to 120 sec.

Further, in this invention, the cold rolled sheet is cooled after it has been maintained at the annealing temperature within the range described above. Cooling is conducted with an aim of preventing precipitation of carbides or carbonitrides and there is no particular restriction for the cooling manner so long as the cooling is conducted at a cooling rate of 5 to 30° C./s.

In this invention, temper rolling may further be applied after the cold rolled sheet annealing. Combination of cold rolled sheet annealing and subsequent temper rolling can easily control the collar as the fixing members for superconductive magnet conductor wires to a required mechanical strength. The temper rolling is conducted in a cold state, preferably, at a room temperature to 150° C., and the draft ratio is controlled in accordance with the desired strength. The draft ratio is desirably 30% or lower. When the draft ratio in the temper rolling exceeds 30%, the internal strains increase excessively to deteriorate the flatness after slitting/punching.

FIG. 2 shows a relation between the draft ratio in the temper rolling and the hardness after temper rolling. As can be seen from FIG. 2, the hardness Hv increases from 170 to 270 and 0.2% yield point increases from about 300 MPa to about 700 MPa by changing the draft ratio from 0.5 to 15%. Even if the temper rolling at such a draft ratio is applied, since the austenitic phase is extremely stable in the high Mn non-magnetic steel sheet according to this invention, the permeability is kept at as low as about 1.001 and this low permeability scarcely changes even at a cryogenic temperature such as 4 K.

EXAMPLE

Steel materials of chemical compositions shown in Table 1 were melted in a converter and formed into slabs by a continuous casting process. The slabs were applied with hot rolling under the conditions shown in Table 2 to form hot rolled sheets of 5.0 mm thickness. Then, the hot rolled sheets were applied with hot rolled sheet annealing under the conditions shown in Table 2, applied with pickling treatment and then to cold rolling into cold rolled sheets of 1 to 3 mm thickness. The cold rolled sheets were applied with cold rolled sheet annealing under the conditions as shown in Table 2 and rapid cooling was conducted after the annealing. A dry AX gas was used as the annealing atmosphere for the cold rolled sheet annealing. The cooling rate after the cold rolled sheet annealing was about 15° C./s.

Then, after applying pickling to the cold rolled sheets after annealing, temper rolling was further applied under the conditions shown in Table 2.

The thus obtained steel sheets were subjected to: (1) observation for the appearance of hot rolled sheet with naked eyes, (2) tensile test at room temperature and at 4 K, (3) measuring test for permeability at room temperature and 4 K using a vibrating sample magnetometer, (4) measuring test for average thermal expansion coefficient at a temperature range from room temperature to liquid nitrogen temperature and (5) precision punching test by fine blanking. The flatness was evaluated for the entire portion of 200×200 mm steel sheets as: ○ where warp was 0.2 mm or less, as Δ where it was from 0.2 mm to 0.5 mm and as X where it was more than 0.5 mm. In the precision punching test, circular 50 mmϕ test pieces were punched and the punching accuracy for the punched test specimens was measured. The punching accuracy was measured by the height of burrs and evaluated as ○ in a case of 20 μm or lower, as Δ in a case of from 20 μm to 50 μm and as X in a case of higher than 50 μm.

As existent examples, tests (2)–(5) were conducted for thin Ti alloy (5% Al-2.5% Sn—Ti) sheets of 2.5 mm thickness, thin Al alloy (5% Mg-0.6% Mn—Al) sheets and thin SUS 304 cold rolled sheets.

The result of the test are shown in Table 3.

TABLE 1

| Steel | Chemical composition (wt %) | | | | | | | |
|---|---|---|---|---|---|---|---|---|
| No. | C | Mn | Cr | Ni | N | S | Ca | O |
| A | 0.09 | 28.5 | 8.0 | 1.2 | 0.11 | 0.002 | 0.006 | 0.004 |
| B | 0.09 | 29.0 | 7.5 | — | 0.11 | 0.002 | 0.0065 | 0.004 |
| C | 0.09 | 28.5 | 8.0 | — | 0.11 | 0.003 | 0.007 | 0.005 |
| D | 0.14 | 29.5 | 6.0 | 2.5 | 0.10 | 0.002 | 0.006 | 0.004 |
| E | 0.09 | 29.0 | 7.5 | 0.8 | 0.11 | 0.003 | 0.0075 | 0.003 |
| F | 0.10 | 27.5 | 7.0 | 2.5 | 0.10 | 0.003 | 0.007 | 0.005 |
| G | 0.20 | 22.0 | 11.5 | — | 0.03 | 0.003 | 0.008 | 0.005 |
| H | 0.12 | 25.0 | 8.0 | — | 0.10 | 0.002 | 0.006 | 0.004 |
| I | 0.02 | 28.5 | 8.0 | — | 0.10 | 0.003 | 0.008 | 0.005 |
| J | 0.10 | 28.5 | 8.0 | — | 0.20 | 0.002 | 0.007 | 0.004 |

TABLE 2

| Steel | | Hot rolling condition | | Hot rolled sheet annealing | Cold rolled sheet annealing | Temper rolling | |
|---|---|---|---|---|---|---|---|
| sheet No. | Steel No. | Start temp (° C.) | End temp (° C.) | Annealing temp (° C.) | Annealing temp (° C.) | Draft % | Sheet thickness mm |
| 1 | A | 1100 | 900 | 1050 | 1100 | 5 | 2.5 |
| 2 | B | 1080 | 850 | 1050 | 1050 | 3.5 | 1.5 |
| 3 | A | 1080 | 800 | 1050 | 1050 | 10 | 2.5 |
| 4 | C | 1030 | 750 | 1050 | 1100 | 5 | 2.5 |
| 5 | D | 1100 | 900 | 1050 | 1100 | 10 | 2.5 |
| 6 | D | 1080 | 790 | 1050 | 1050 | 3 | 2.5 |
| 7 | B | 1120 | 900 | 1050 | 1050 | 5 | 2.5 |
| 8 | E | 1050 | 850 | 1050 | 1100 | 10 | 2.5 |
| 9 | F | 1080 | 850 | 1050 | 1050 | 3 | 2.5 |

TABLE 2-continued

| Steel sheet No. | Steel No. | Hot rolling condition Start temp (° C.) | End temp (° C.) | Hot rolled sheet annealing Annealing temp (° C.) | Cold rolled sheet annealing Annealing temp (° C.) | Temper rolling Draft % | Sheet thickness mm |
|---|---|---|---|---|---|---|---|
| 10 | F | 1120 | 900 | 1050 | 1050 | 5 | 2.5 |
| 11 | E | 1050 | 850 | 1050 | 1100 | 15 | 2.5 |
| 12 | F | 1120 | 900 | 1050 | 1050 | 1 | 2.5 |
| 13 | G | 1100 | 900 | 1050 | 1050 | 5 | 2.5 |
| 14 | H | 1100 | 920 | 1050 | 900 | 10 | 2.5 |
| 15 | A | 1020 | 650 | 1050 | 1050 | 3 | 2.5 |
| 16 | A | 1250 | 950 | 1050 | 1100 | 10 | 2.5 |
| 17 | I | 1100 | 900 | 1050 | 1050 | 3 | 2.5 |
| 18 | J | 1100 | 900 | 1050 | 1100 | 10 | 2.5 |
| 22 | K | Ti alloy (Al: 5%, Sn: 2.5%) cold rolled sheet | | | | | 2.5 |
| 23 | L | Al alloy (Mg: 5%, Mn 0.6%) cold rolled sheet | | | | | 2.5 |
| 24 | M | SUS 304 (Cr: 18%, Ni: 8%, C: 0.02%, Mn: 1.5%) cold rolled sheet | | | | | 2.5 |

TABLE 3

| Steel sheet No. | Steel No. | Appearance Crack | Permeability 4 K | Permeability Room temp | Thermal expansion coefficient Unit: $K^{-1}$ RT - 77 K (average) | Hardness HV (RT) | Tensile property Room temperature 0.2% yield point Mpa | Room temperature Tensile strength MPa | 4 K 0.2% yield point Mpa | 4 K Tensile strength MPa | Precision punching Flatness | Precision punching Punching accuracy | Remarks |
|---|---|---|---|---|---|---|---|---|---|---|---|---|---|
| 1 | A | ◎ | 1.0013 | 1.0011 | $7.6 \times 10^{-8}$ | 222 | 477 | 689 | 1050 | 1348 | ○ | ○ | Example |
| 2 | B | ◎ | 1.0013 | 1.0012 | $7.6 \times 10^{-8}$ | 210 | 423 | 630 | 948 | 1195 | ○ | ○ | Example |
| 3 | A | ◎ | 1.0015 | 1.0013 | $7.6 \times 10^{-8}$ | 248 | 550 | 732 | 1208 | 1387 | ○ | ○ | Example |
| 4 | C | ○ | 1.0014 | 1.0012 | $7.7 \times 10^{-8}$ | 221 | 478 | 669 | 1056 | 1273 | ○ | ○ | Example |
| 5 | D | ◎ | 1.0015 | 1.0012 | $7.5 \times 10^{-8}$ | 245 | 531 | 725 | 1165 | 1378 | ○ | ○ | Example |
| 6 | D | ◎ | 1.0014 | 1.0011 | $7.5 \times 10^{-8}$ | 208 | 420 | 645 | 924 | 1225 | ○ | ○ | Example |
| 7 | B | ◎ | 1.0014 | 1.0012 | $7.6 \times 10^{-8}$ | 224 | 472 | 677 | 1045 | 1292 | ○ | ○ | Example |
| 8 | E | ◎ | 1.0015 | 1.0013 | $7.6 \times 10^{-8}$ | 250 | 554 | 730 | 1220 | 1387 | ○ | ○ | Example |
| 9 | F | ◎ | 1.0014 | 1.0012 | $7.6 \times 10^{-8}$ | 210 | 425 | 640 | 931 | 1216 | ○ | ○ | Example |
| 10 | F | ◎ | 1.0015 | 1.0013 | $7.6 \times 10^{-8}$ | 227 | 482 | 679 | 1062 | 1292 | ○ | ○ | Example |
| 11 | E | ◎ | 1.0015 | 1.0013 | $7.6 \times 10^{-8}$ | 270 | 618 | 775 | 1359 | 1472 | ○ | ○ | Example |
| 12 | F | ◎ | 1.0014 | 1.0012 | $7.6 \times 10^{-8}$ | 180 | 364 | 628 | 802 | 1193 | ○ | Δ | Example |
| 13 | G | ◎ | 1.010 | 1.007 | $12.1 \times 10^{-8}$ | 230 | 492 | 695 | 1082 | 1320 | ○ | ○ | Comp. Example |
| 14 | H | ◎ | 1.015 | 1.009 | $10.5 \times 10^{-8}$ | 235 | 510 | 705 | 1122 | 1338 | ○ | ○ | Comp. Example |
| 15 | A | x | 1.0014 | 1.0012 | $7.6 \times 10^{-8}$ | 225 | 477 | 680 | 1050 | 1292 | ○ | ○ | Comp. Example |
| 16 | A | x x | 1.0015 | 1.0013 | $7.6 \times 10^{-8}$ | 248 | 548 | 735 | 1206 | 1396 | ○ | ○ | Comp. Example |
| 17 | I | ◎ | 1.0014 | 1.0013 | $7.7 \times 10^{-8}$ | 150 | 305 | 603 | 671 | 1146 | ○ | x | Comp. Example |
| 18 | J | ◎ | 1.0011 | 1.008 | $7.5 \times 10^{-8}$ | 280 | 655 | 800 | 1442 | 1520 | ○ | ○ | Comp. Example |
| 22 | S | ◎ | 1.008 | 1.005 | $7.5 \times 10^{-8}$ | 260 | 680 | 720 | 1390 | 1480 | Δ | ○ | Existent Example |
| 23 | T | ◎ | 1.005 | 1.003 | $16.5 \times 10^{-8}$ | 190 | 162 | 303 | 185 | 590 | ○ | x | Existent Example |
| 24 | U | ◎ | 1.08 | 1.010 | $12 \times 10^{-8}$ | 225 | 252 | 690 | 255 | 1607 | Δ | ○ | Existent Example |

In the examples of this invention, occurrence of edge cracks and fine cracks were scarcely observed on the surface of hot rolled sheets and the appearance of the hot rolled sheets was favorable. In the examples of this invention, tensile strength at a cryogenic temperature (4 K) is high and it has a sufficient strength as structural materials for large scale particle accelerators. Further, the average thermal expansion coefficient in the examples of this invention is smaller compared with that of austenitic stainless steels (about $11\times10^{-6}$), and it shows a value closely approximate to that of pure iron used generally as yoke materials for superconductive magnets.

The permeability in the examples of this invention is low also at room temperature and cryogenic temperature, and shows less temperature dependence. Further, in the examples of this invention, defects such as warps and burrs did not occur even when conducting precision punch and, further, the flatness and punching accuracy were also satisfactory (○).

On the contrary, comparative examples out of this invention caused cracks on the surface of steel sheets to show defective appearance, and had high permeability at cryogenic temperature and poor flatness and poor punching accuracy in a precision punching test.

Further, the examples of this invention show lower permeability and lower thermal expansion coefficient compared with existent examples and have sufficient performance for use at cryogenic temperature.

According to this invention, a high Mn non-magnetic steel sheet showing high yield stress (yield point) at cryogenic temperature, low magnetic permeability at cryogenic temperature and low average thermal expansion coefficient can be industrially manufactured stably and at high productivity to provide outstanding industrial effects. Further, the high Mn non-magnetic steel sheet according to this invention has sufficient characteristics for large scale particle accelerators and it is industrially useful.

What is claimed is:

1. A method of manufacturing a cold rolled high Mn non-magnetic steel sheet for cryogenic temperature use, which comprises:

heating a steel material consisting essentially of, on a weight percent basis:

from 0.05 to 0.18% of C
from 26.0 to 30.0% of Mn,
from 5.0 to 10.0% of Cr,
from 0.05 to 0.15% of N,
from 0.01 to 0.07% of Al,
from 0.01 to 0.1% of V,
from 0.1 to 1.0% of Si,
from 0.003 to 0.02% of Ca and balance being Fe and inevitable impurities and hot rolling the material into a hot rolled steel sheet, annealing the hot rolled sheet and then cold rolling to form a cold rolled sheet and then annealing the cold rolled sheet, in which a hot rolling start temperature is from 1050 to 1200° C. and a rolling end temperature is 700 to 1000° C. for the hot rolling and, further, the annealing temperature for the cold rolled sheet annealing is from 1050 to 1200° C.

2. The method of manufacturing a cold rolled high Mn non-magnetic steel sheet for cryogenic temperature use as defined in claim 1, in which the steel material consists essentially of, on a weight percent basis:

from 0.05 to 0.18% of C
from 26.0 to 30.0% of Mn,
from 5.0 to 10.0% of Cr,
from 0.50 to 5.0% of Ni,
from 0.05 to 0.15% of N,
from 0.01 to 0.07% of Al,
from 0.01 to 0.1% of V,
from 0.1 to 1.0% of Si,
from 0.003 to 0.02% of Ca and balance being Fe and inevitable impurities.

3. The method of manufacturing a cold rolled high Mn non-magnetic steel sheet for cryogenic temperature use as defined in claim 1, further comprising temper rolling after the cold rolled sheet annealing.

4. The method of manufacturing a cold rolled high Mn non-magnetic steel sheet for cryogenic temperature use as defined in claim 2, further comprising temper rolling after the cold rolled sheet annealing.

* * * * *